United States Patent [19]

Schulte

[11] Patent Number: 4,858,346

[45] Date of Patent: Aug. 22, 1989

[54] BUCKET COVER FOR EXCAVATING IMPLEMENTS

[76] Inventor: Frank Schulte, P.O. Box 26, Mayo, Fla. 32066

[21] Appl. No.: 89,775

[22] Filed: Aug. 27, 1987

[51] Int. Cl.[4] ..... B66C 3/02; E02F 3/00; E02F 3/40

[52] U.S. Cl. ..... 37/184; 37/118 R; 37/DIG. 12; 414/704

[58] Field of Search ..... 37/117.5, 118, 184, 37/DIG. 3, DIG. 12; 220/352; 414/690, 722, 726, 704, 694

[56] References Cited

U.S. PATENT DOCUMENTS

| | | | |
|---|---|---|---|
| 2,263,472 | 11/1941 | Reichenbach | 220/352 X |
| 3,003,265 | 10/1961 | Lutjens | 414/726 |
| 3,460,691 | 8/1969 | Wieger et al. | 37/DIG. 3 X |
| 3,477,602 | 11/1969 | Peterson | 414/726 |
| 3,737,059 | 6/1973 | Peterson et al. | 37/184 X |
| 3,807,589 | 4/1974 | Shovick | 37/117.5 X |
| 3,973,764 | 8/1976 | Holzer, Jr. | 269/46 X |
| 4,266,908 | 5/1981 | Leiker | 414/690 |

FOREIGN PATENT DOCUMENTS

| | | | |
|---|---|---|---|
| 142479 | 5/1985 | European Pat. Off. | 37/DIG. 12 |

*Primary Examiner*—Edgar S. Burr
*Assistant Examiner*—Moshe L. Cohen
*Attorney, Agent, or Firm*—Dowell & Dowell

[57] ABSTRACT

Covers are mounted so as to cooperatively close and seal the mouth or opening into conventional backhoe and clam-shell excavating buckets with the covers being positioned or positionable so as to engage the buckets after the buckets have been operated or manipulated to excavate earthen material or debris to thoroughly enclose such materials within the buckets until such time as the material is deposited into an appropriate receptacle or deposit site.

14 Claims, 3 Drawing Sheets

BUCKET COVER FOR EXCAVATING IMPLEMENTS

BACKGROUND OF THE INVENTION

1. Field of the Invention

This invention is generally related to earth working or excavating equipment and more specifically to covers for cooperatively and selectively engaging with and sealing the opening or mouth of conventional backhoe and clam-shell buckets to thereby prevent the accidental discharge or spillage of any material excavated or dredged using such equipment. The covers may either be fixedly located so as to be engaged by the buckets when the buckets assume a closed or fully scooped position or may be selectively movable so as to permit relative movement of the covers with respect to an associated bucket. In the preferred embodiment, the covers are structured so as to be flexible and expandable relative to the bucket so that any material which has been excavated but which extends above the opening in the buckets will be closed in the expanded covers.

2. History of the Related Art

Inland and coastal waterways are continuously being threatened by increases or buildups of waste and sludge deposits as well as natural increases in siltation. Soil deposits not only clog water channels threatening or restricting navigational passage but also adversely affect the quality of water by creating concentrated areas of contaminants and pollutants. As our society continues to grow and expand, it is paramount that the environmental soundness and quality of our waterways and water recreational areas be maintained and preserved. This requires the removal or dredging of our waterways to remove waste and sludge deposits and natural and man made sedimentations.

To date, dredging operations have been accomplished by mechanical digging debris and sedimentations, by pumping lose or fine sedimentations from subsurface areas or by combinations of earth working and pumping. In those areas where the deposits or sedimentations include toxic or hazzardous wastes including chemical concentrations from manufacturing or processing plants or chemical run-offs from locally fertilized lands, the deposits or sedimentations must be carefully handled and transported and/or treated to permit their safe disposal. Unfortunately, conventional dredging and earth working equipment has not been designed to adequately handle waste removals without creating additional problems such as releasing loose sedimentation into downstream flows as wastes and other materials are scooped and lifted from subsurface areas.

When dredging or digging using bucket type earthworking equipment including backhoe, extendable boom mounted buckets and clam-shell buckets, large quantities of earth, silt, debris, rocks, etc., may be raised with each scoop. However, as such material is lifted, the excess materials above and within the open rims of the buckets are often dislodged. In underwater dredging operations, the excess materials excavated with each scoop of a conventional bucket are often dislodged and entrained in the water thereby adversely increasing the turbidity of the water or causing such materials to be deposited into downstream areas. In instances where potentially hazardous or toxic materials are being dredged, any realease of solid materials away from the dredging site is totally undesirable and potentially unhealthful for those areas to which such materials may be transported or conveyed.

To date, no one has developed a system or equipment to permit adequate handling of excavated waste materials and especially dredged waste materials without creating further waste spillage, release or distribution of the materials being handled. In U.S. Pat. No. 3,807,539 to Shovick, a supplemental bucket is shown as being used with a conventional backhoe bucket so as to create an implement which will have opposing portions which will operate as jaws to grasp material or to substantially entrap material therebetween. The supplemental or auxiliary bucket is fixedly secured to the backhoe dipper stick adjacent the conventional bucket. The edges of the auxiliary bucket are further designed to be complimentary to the edges of the conventional bucket when the conventional bucket reaches a full closed position with respect thereto. Unfortunately, if such a bucket arrangement were utilized in the dredging or digging of contaminated waste, loose material would be dislodged or discharged from between the two buckets as they close with respect to one another. Also, although the edges of the buckets are complementary in shape, they do not seal with respect to one another so material may pass from therebetween during use, and especialy during use in an underwater environment.

In U.S. Pat. No. 3,737,059 to Peterson et al., another combination earth working bucket is disclosed wherein each of auxiliary and primary buckets is selectively pivotally movable with respect to the opposing bucket. As with the aforesaid patent to Shovick, the combination bucket of Peterson, et al., is also not adequately designed to use in excavating contaminated or waste debris especially in aqueous environments without allowing a substantial portion of the material being excavated from being spilled and entrained in the surrounding waterway. The operation of the Peterson, et al. structure is similar to a conventional clam-shell type bucket and therefore the top of the auxiliary bucket is opened. Collected materials could therefore be washed from or overflow from the opened structure when the bucket is being filled with material. Further, the interface between the bucket components is not sealed so that materials may also pass between the opposing edges of the buckets when in use.

Some additional examples of multi-componented excavation buckets include U.S. Pat. Nos. 3,003,265 to Lutjens and 3,477,602 to Peterson.

SUMMARY OF THE INVENTION

This invention is directed to fixed or moveable covers for closing the openings in conventional backhoe, clam-shell or extendable boom mounted earth working buckets. Depending upon the type of equipment, the covers may be mounted either adjacent to or directly to the conventional or existing bucket. Each cover includes a recessed body portion defined by outer edges which are designed to cooperatively engage with and be seated or sealed with the edges defining the opening into the conventional bucket. In those instances where the bucket is of a clam-shell configuration having opposing jaws with the buckets being opened at the top, a cover will be mounted to each bucket section whereas with single bucket configurations, the cover will be mounted in spaced relationship with respect thereto. In those instances where the cover is spaced from the bucket, the cover will be supported by frame carried by a pair of connector arms that extend from the equipment dipper stick. The edge portions of the cover will be cooperatively seated with the edges of the conventional bucket as the bucket is pivoted relative to the cover. If the cover is movable, suitable hydraulic cylinders are provided to pivot the cover toward or away from the bucket under control of the operator.

In the preferred embodiment, each cover is constructed of a flexible and yieldable material which forms the central or body portion thereof and which material is integrally formed with or secured to a sealing frame which extends around the edges of the central body portion. The flexible central portion may include a plurality of accordioned sections which permit the body to be easily expanded so as to be adaptable to enclose various quantities or volumes of scooped debris, silt, dirt or other materials.

It is a primary object of the present invention to provide covers for conventional excavating and dredging equipment which will cooperate with the buckets used with such equipment to enclose and retain substantially all the material which is scooped or dislodged with each digging motion of the bucket of the earth working equipment.

It is another object of the present invention to provide flexible covers or closures for sealing conventional excavating buckets so that such buckets may be utilized to dredge sludge, contaminants and other toxic or hazardous waste from underwater locations while minimizing the release of silts and sediments which would otherwise increase water turbility and contribute to downstream pollution.

It is yet another purpose of the present invention to provide flexible covers or closures for use with conventional excavating buckets wherein the covers are expandable in order to permit the ready acceptance of what would be overflow material into an enclosed cavity created between the outwardly flexible cover and the conventional bucket.

Another object of the present invention is to provide a movable cover for use with conventional earth working buckets wherein the cover may be selectively brought into place enclosing the material in a bucket and thereafter sealing the closure or cover with respect to the opening in the bucket to prevent discharge of materials therefrom.

It is yet another object of the present invention to provide a flexible cover for closing the openings in conventional excavating buckets wherein the covers are yieldable so as to provide clearance for large objects which are excavated and extend outwardly of the buckets and yet will tend to close any openings created by the interference of such larger objects with the buckets.

DESCRIPTION OF THE PREFERRED EMBODIMENT

Figure 1:
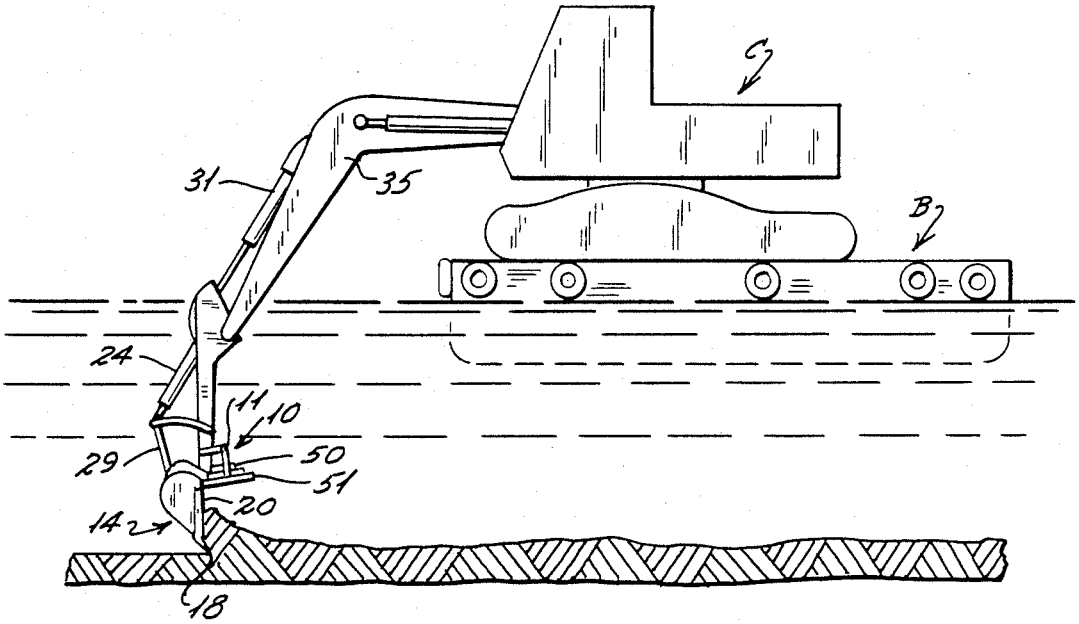
FIG. 1 is an illustrational view of a dredging operation utilizing a barge and crawler crane with backhoe having the cover of the present invention fixedly attached to the dipper stick of the crane boom.

With continued reference to the drawings, the excavation covers of the present invention will be discussed in three separate embodiments. It is envisioned that the expandable excavation covers of the invention may be utilized with substantially any form of conventional earth working or excavating bucket. In FIG. 1, a first fixed excavator bucket cover 10 is disclosed being attached by way of a pair of L-shaped mounting frame members 11 and 12 to the lower boom element or dipper stick 13 of a conventional crane C. The crane is shown as being utilized for dredging underwater areas and is supported on a barge B.

The crane C also includes a conventional backhoe type bucket 14 having closed side walls 15 and 16 and continuous arcuate bottom or back wall 17 which terminates at a cutting edge 18. An opening 19 is defined into the bucket by upper edges including side edges 20 and 21, rear edge 22 and the front cutting edge 18. The bucket 14 is pivotally attached at 23 to the lower end of the boom element 13. The bucket is maneuvered by a hydraulic cylinder 24 which is fixed to a flange 25 carried by the upper end of the boom element 13. The end 26 of cylinder rod 27 is connected to a pair of linkage elements 13, which are pivotally attached to the boom element 13, and to connector links 29 which are joined to a flange 30 secured to the rear wall 17 of the bucket.

The articulation of beam element 13 is controlled by a second hydraulic cylinder 31 having fixed ends secured to flanges 32 carried by the primary crane boom 35. The outer end 36 of the hydraulic cylinder control rod 37 is pivotally connected at 38 to the uppermost end of the dipper stick or boom element 13. A second pivot connection 39 is also made between the upper end of the boom element 13 and the outermost end 40 of the primary boom 35.

Figure 2:
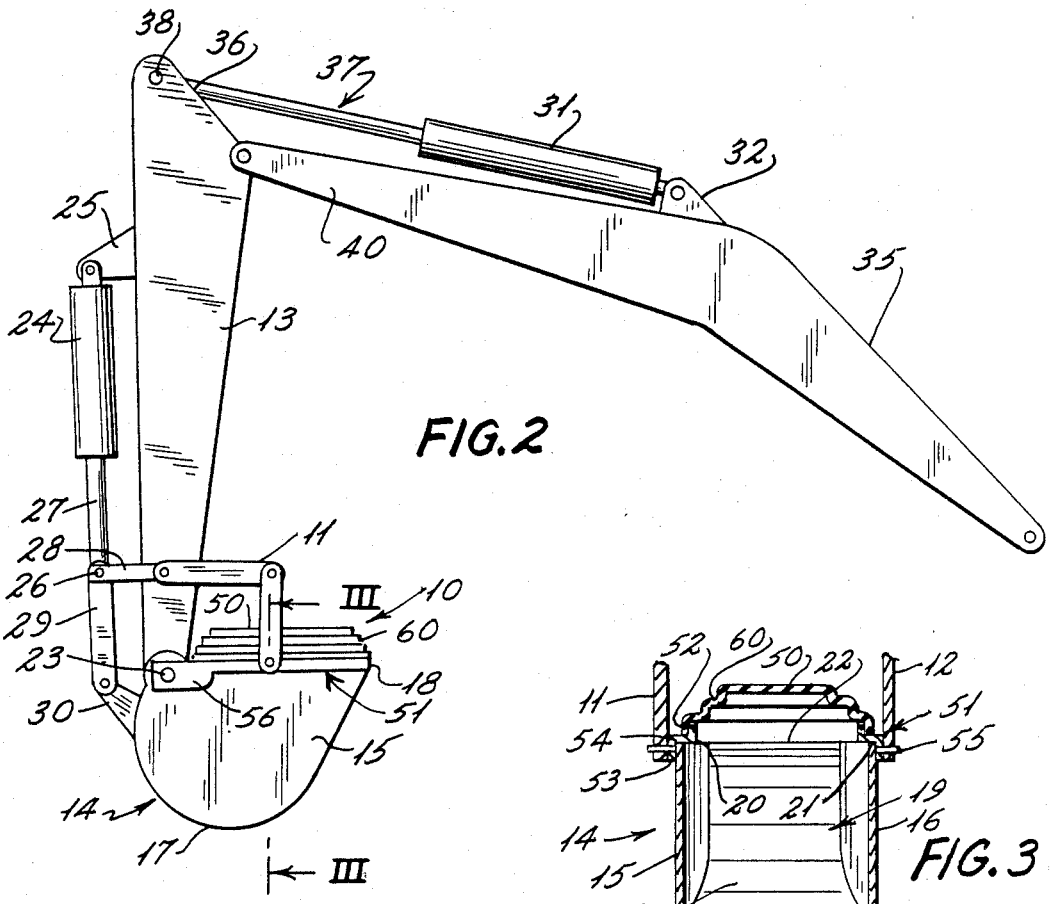
FIG. 2 is an enlarged side elevational view of the cover of the present invention as it is closed over the opening in the bucket of the crane of FIG. 1 as the bucket is pivoted to its fully loaded position.
Figure 3:
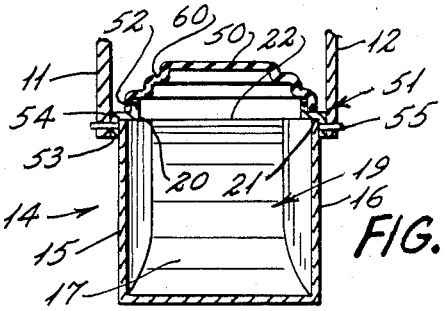
FIG. 3 is a cross sectional view taken along lines III—III of FIG. 2.

In the embodiment of the invention shown in FIGS. 1 and 2, the bucket cover 10 is shown as being fixedly mounted to the dipper boom section 13 by a pair of non-pivotting L-shaped links 11 and 12 in such a manner that the cover is oriented generally parallel to the upper edges of the bucket when the bucket is in a fully closed digging or scooping position as shown in FIG. 2. The cover 10 includes a primary or central body portion 50 which is either fixedly secured or integrally formed with a continuous outer frame member 51.

The outer frame member 51 is shown as being somewhat Z-shaped having an inner flange 52, outer flange 53 and intermediate portion 54. The intermediate portion is of sufficient size and shape so as to form a continuous seal accross the upper edges defining the opening 19 into the bucket. In this respect, in those instances where ripper teeth are incorporated along the front cutting edge 18 of the bucket, the intermediate portion and the outer flange of the frame member 51 may be either formed so as to cooperatively seat with the walls of the bucket immediately adjacent the teeth or may be formed so as to be cooperatively seated through or over the teeth so as to insure a complete closure of the bucket opening.

The outer flanges 53 of the opposite side portions of the frame member 51 are secured by any suitable fasteners 55 to the mounting frame members 11 and 12. The opposite side portions of the mounting frame also include extensions 56 which are connected at 23 and which are fixed with respect to the boom so that the cover 10 is retained in aligned position relative to the bucket 14.

The exact shape and structure of the frame members for the covers may vary. It is important that whatever configuration is used that a substantially flush and secure seal be created between the cover and the bucket when these components are closed relative to one another. With the Z-shaped configuration, the lower edge of the covers are sealed with the upper flange 52 while the outer flanges extend generally contiguous to the upper outer wall portions of the bucket. Also, the cover, may, in some instances, be mounted so as to be longitudinally movable with respect to the bucket to create a sealing function as opposed to being fixedly retained in a single position as shown in FIG. 2.

The cover frame members 51 may be constructed of steel or other metal or may be formed of a rubber, synthetic rubber or yieldable plastic material which would enable the frame to exhibit some degree of flexibility. By forming the frame of a slightly resilient material, the frame will be adapted to conform about objects which may extend outwardly of a bucket during a dredging or digging operation and yet create a substantial seal with the remaining portions of the bucket The central portion 50 of the cover is preferably constructed of a rubber or synthetic rubber material and is specifically designed so as to be readily expandable and/or yieldable to accomodate and cooperatively receive varying volumes or quantities of excavated or dredge materials which are deposited above the opening in a bucket. In order to accomodate the expansion of the central portion of the cover, the central portion is constructed having a plurality of accordion sections 60. The accordion configuration will enable the central portion of the cover to expand uniformly as the cover is aligned in overlying relationship with respect to the bucket.

Figure 4:
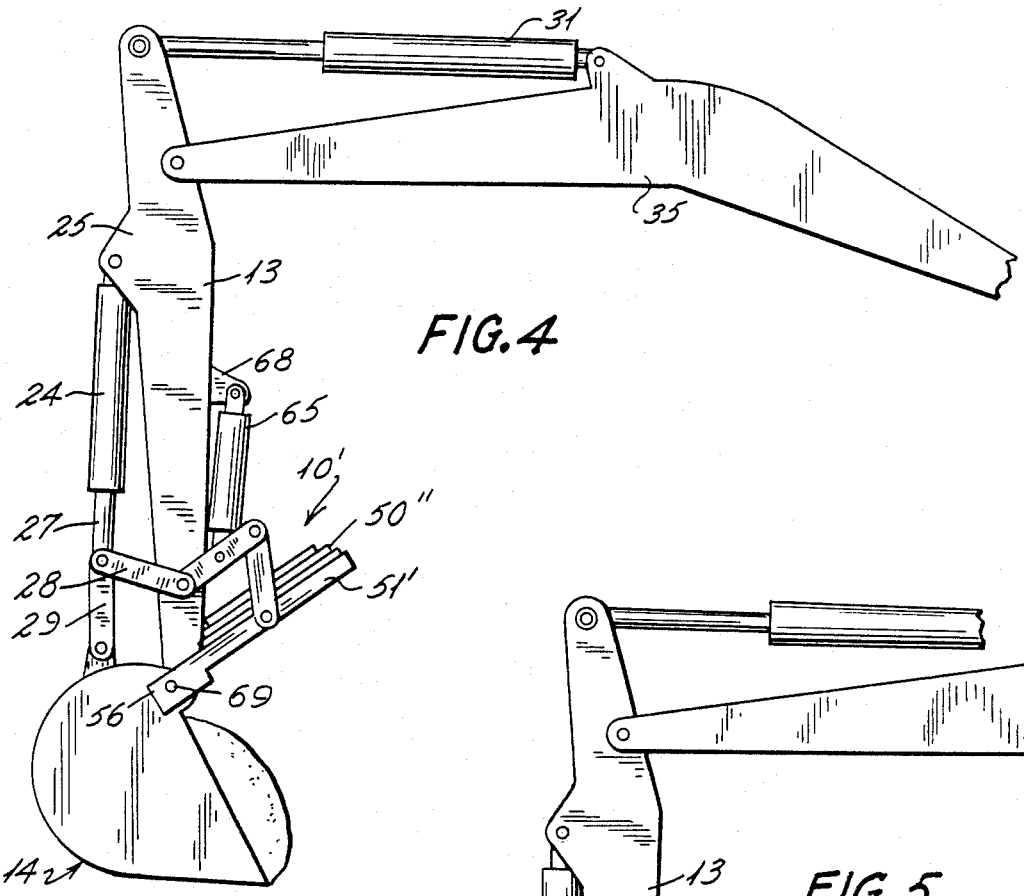
FIG. 4 is an enlarged side elevational view similar to that of FIG. 2 showing a second embodiment of the present invention wherein the cover is pivotally mounted for independent movement with respect to the dipper stick of the crane and showing the crane bucket in a loading position.
Figure 5:
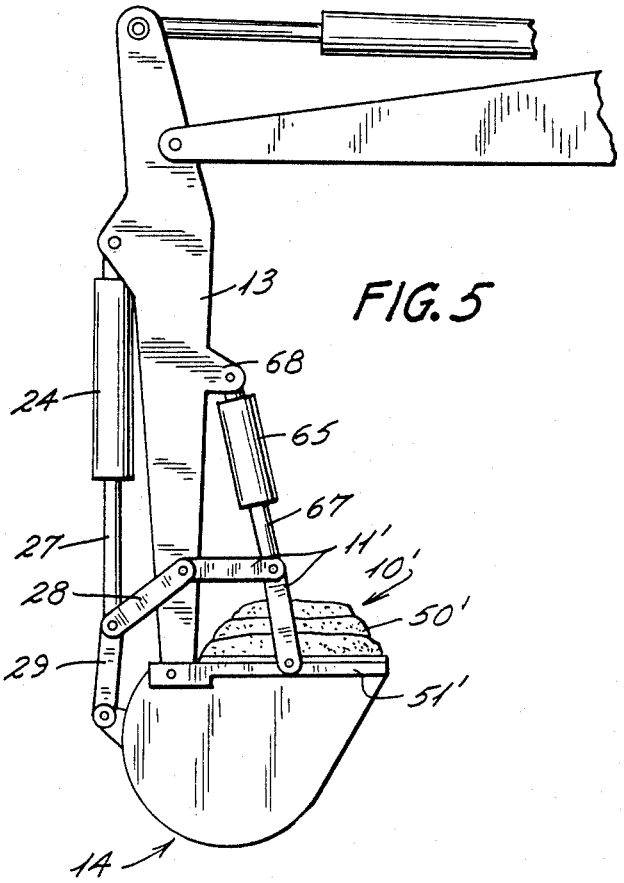
FIG. 5 is an enlarged side elevational view similar to FIG. 4 showing the cover of the present invention as it is pivoted or moved into overlying relationship with the filled bucket of FIG. 4.
Figure 6:
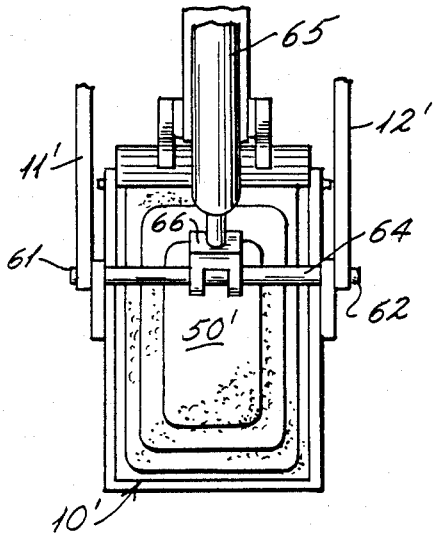
FIG. 6 is a top plan view of the cover as closed over the bucket of FIG. 5.

With reference to FIGS. 4–6, a second embodiment of the present invention is shown in greater detail. In this embodiment, the cover 10' is mounted to the dipper arm or lower boom member 13 so as to be movable with respect to the bucket. In this embodiment, the L-shaped mounting frame members 11' and 12' are pivotally secured at 61 to opposite sides of the lower boom element 13. The sides of the frame member 5' of cover 10' are pivotally joined at 63 to the L-shaped frame. The L-shaped frames are also joined by a cross brace 64 that is operatively connected to a hydraulic cylinder 65 by way of a connector 66 carried at one end of the piston rod 67 of the cylinder 65. The cylinder 65 is secured to flange elements 68 mounted to the upper portion of the lower boom element 13. In this embodiment, the extensions 56 of the frame member are pivotally connected at 69 to the bucket and lowermost portion of the lower boom element 13.

In the embodiment of FIGS. 4–6, the hydraulic cylinder is selectively operated to move the cover 10' relative to the bucket as the bucket is maneuvered through a digging or dredging motion. The movable cover can thereby be used to insure positive enclosing of excess materials scooped by the bucket without requiring the bucket to be rotated to a fully closed position. Thus, when the bucket is in a position as shown in FIG. 5, the cover may be selectively operated to enclose the material extending beyond the opening therein to thereby prevent any spillage of such excess materials from the bucket.

Figure 7:
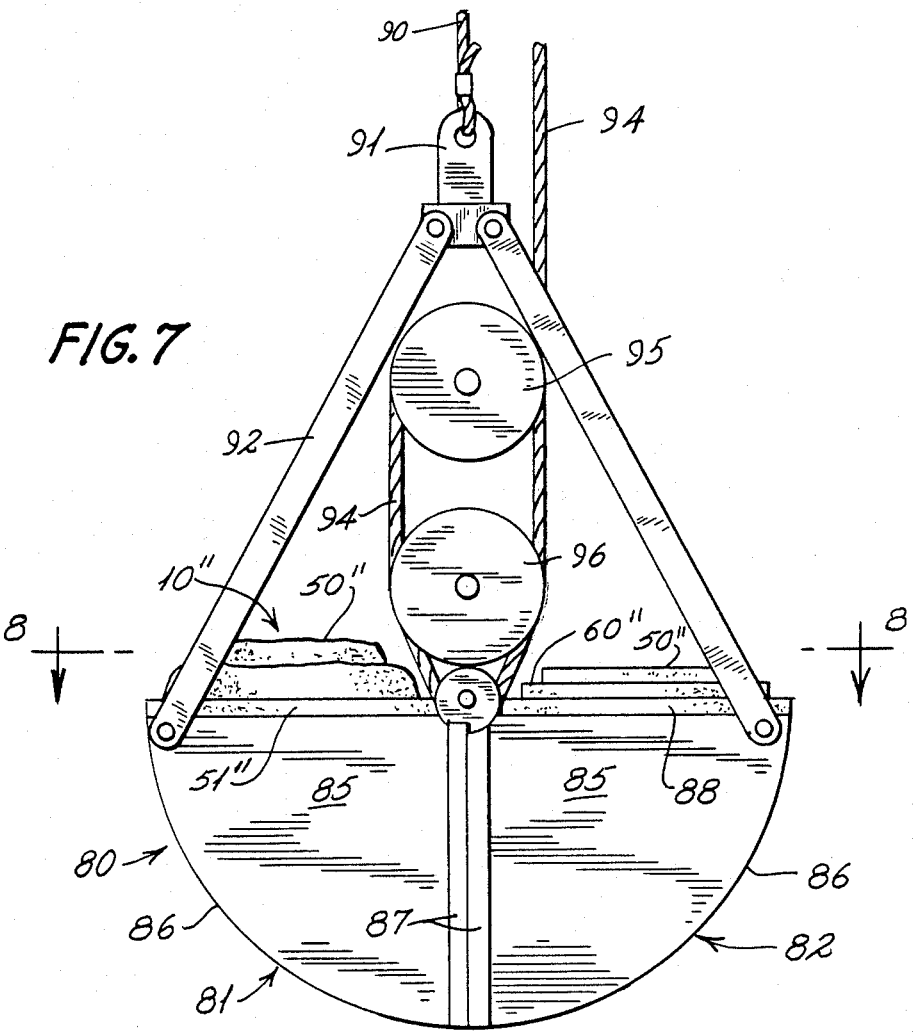
FIG. 7 is a front elevational view of another embodiment of the present invention showing the covers utilized with a conventional clam-shell type bucket.
Figure 8:
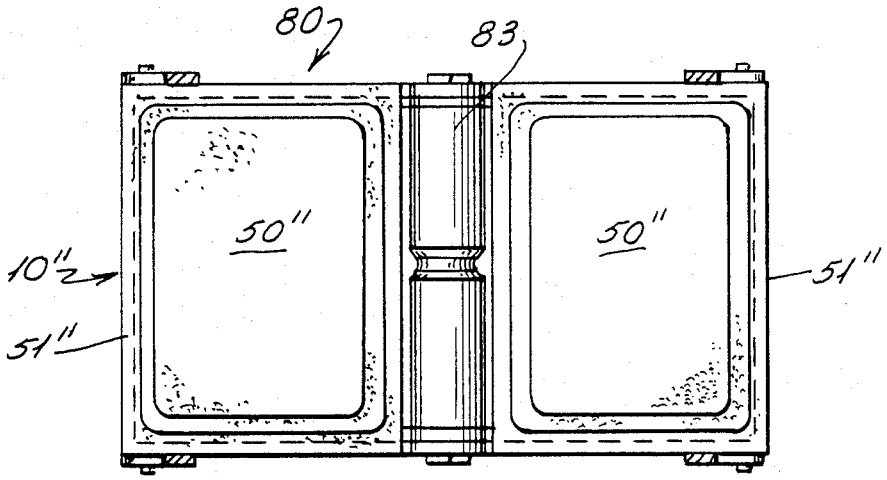
FIG. 8 is a top plan view of the invention of FIG. 7.

With reference to FIGS. 7 and 8, a third embodiment of the present invention is disclosed wherein the bucket covers 10'' of the invention are shown as being used with conventional clam-shell buckets 80. The clam-shell buckets include a pair of opposing bucket sections 81 and 82 which are pivotally connected about a common shaft 83. Each bucket section includes opposing side walls 84 and 85 and arcuate bottom walls 86. The bucket sections also include opposing jaws 87 which abut one another when the sections are closed to confine material therebetween. The upper portion or edges 88 of the bucket sections are open so that during normal dredging operations, excavated materials may be subjected to being washed from between the bucket sections. To prevent such washing or displacement of materials, each bucket section is provided with a bucket cover 10'' which is fixedly secured to the upper edges 88 defining the upper openings into each bucket section.

In this embodiment, the cover frame portions 51'' are directly secured to the upper edges of each of the bucket sections and the central portions 50'' are expandable upwardly with respect thereto as shown in the left side of FIG. 7. As with the previous embodiments, the central portions of the covers are preferably shaped having a plurality of accordioned sections 60'' which will facilitate the expansion of the covers as material is being lifted vertically with respect thereto.

The clam-shell buckets are lifted by way of cable 90 which is mounted to a yolk member 91. Opposite pairs of bucket pivot arms 92 extend from the yolk member to the upper and outer edges of the bucket sections. The clam-shell bucket is opened and closed by a closing line 94 which extends around a pair of spaced pulleys 95 and 96 and about the shaft 83.

In the use of this embodiment, as the dredging material is enclosed between the bucket sections, the excess materials will cause the flexible body portions 50'' of the covers 10'' to expand upwardly with respect to each bucket section. Even if no excess materials are being excavated, the covers 10' will prevent materials from being washed from between the bucket sections as the bucket is raised through the water.

I claim:

1. In excavating equipment having an excavating bucket carried by a boom element which bucket has at least one opening defined by edge portions in which scooped material may be extended as the material is lifted by the bucket, the improvement comprising a cover means, said cover means having a substantially imperforate central body portion and side edge portions, said central body portion being relatively yieldable and expandable outwardly relative to the opening in the bucket to thereby accommodate and enclose and retain scooped material therein, said side edge portions of said cover means being substantially continuous and of a configuration to cooperatively engage and continuously seat with the edge portions defining the opening into the bucket, said cover means selectively closing the opening into the bucket to reduce spillage from the bucket.

2. In the excavating equipment of claims 1, said central body portion being formed of a plurality of integrally formed sections which are foldable in accordioned fashion.

3. In the excavating equipment of claim 1, said side edge portions of said cover means being formed of a yieldable material so as to accommodate for obstructions between said side edge portions and the edge portions defining the opening into the bucket.

4. In the excavating equipment of claim 1, mounting frame means carried by said boom element adjacent the bucket, said mounting frame means having first ends secured to said boom element and second ends, means for securing said side edge portions of said cover means to said second ends of said mounting frame means.

5. In the excavating equipment of claim 4, said mounting frame means being positioned so that said side edge portions of said cover means are in engagement with the edge portions of the bucket when said bucket is fully closed with respect to the boom element.

6. In the excavating equipment of claim 1, pivot mounting means having first ends mounted to said boom element and second ends extending outwardly therefrom, said side edge portions of said cover means being connected to said second ends of said pivot mounting means, piston means having a fixed end connected to said boom element and an extendable end in spaced relationship to said fixed end, and means for connecting said extendable end of said piston means to said pivot mounting means.

7. An excavating implement comprising a clam-shell bucket, said clam-shell bucket having first and second opposing sections, each of said first and second sections having substantially closed opposing side walls which are connected by an arcuate outer wall, each of said side walls and said outer walls having an uppermost edge portion defining openings into said first and second sections of said clam-shell bucket, means for pivotally joining said first and second sections of said clam-shell bucket, at least one cover means, said cover means having a substantially imperforate central body portion and a continuous outer edge portion, said central body portion of said cover means being formed of a flexible material so as to be expandable outwardly with respect to said openings defined by said uppermost edge portions of said side and outer wall portions of said first and second sections, said outer edge portion being configured to cooperatively seat with said uppermost edge portions of said side walls and said outer walls of said first and second sections, said central portion of said cover means closing the openings defined by said uppermost edge portions of said side walls and said outer wall of said first and second sections.

8. The excavating implement of claim 7 including two cover means, each of said cover means being positioned in a sealing relationship with respect to one of said first and second sections.

9. An excavating implement comprising a bucket means, at least one pivotable boom element, means for pivotally mounting said bucket means to said at least one boom element so that said bucket means is pivotable to be extended from or pivoted toward said at least one boom element, said bucket means having upper edge portions defining an opening therein, a cover means, means for mounting said cover means to said at least one boom element adjacent said bucket means, said cover means including a substantially imperforate central body portion and an outer frame portion, said central body portion of said cover means being formed of a flexible material so as to be expandable outwardly with respect to said opening in said bucket means as said bucket means is moved toward said cover means, said outer frame portion being of a configuration to cooperatively seat with said upper edge portions of said bucket means so as to seal said cover means in relationship thereto, whereby said cover means is engagable with said upper edge of said bucket means when said bucket means is pivoted toward said at least one boom element.

10. The excavating implement in claim 9 including means for movably mounting said cover means to said at least one boom element so as to be selectively movable with respect to said bucket means.

11. The excavating implement of claim 10 in which said means for movably mounting said cover means includes at least one hydraulic cylinder means.

12. In excavating equipment having an excavating bucket carried by a boom element which bucket has at least one opening defined by edge portions in which scooped material may be extended as the material is lifted by the bucket, the improvement comprising a cover means, said cover means having a continuous and generally imperforate central body portion and continuous side edge portions, said central body portion being formed of a yieldable material so as to be expansible away from the bucket so as to accommodate varying volumes of scooped material which may extend outwardly of the bucket opening, said side edge portions of said cover means being of configuration to cooperatively engage and continuously seat with the edge portions defining the opening into the bucket, said side edge portions of said cover means being formed of a yieldable material so as to accommodate for obstructions between said side edge portions and the edge portions defining the opening into the bucket, whereby said cover means covers the opening into the bucket to prevent spillage from the bucket.

13. In the excavating equipment of claim 12, mounting frame means carried by the boom element adjacent the bucket, said mounting frame means having first ends secured to said boom element and second ends, means for securing said side edge portions of said cover means to said second ends of said mounting frame means.

14. In the excavating equipment of claim 13, said central body portion being formed of a plurality of integrally formed sections which are foldable in accordioned fashion.

* * * * *